United States Patent [19]

Shinmi et al.

[11] Patent Number: 4,530,868

[45] Date of Patent: Jul. 23, 1985

[54] ELASTOMER-COATED CLOTH COMPOSITE

[75] Inventors: Hideo Shinmi, Ichihara; Yoshitaka Kubota, Chiba, both of Japan

[73] Assignee: Toray Silicone Company, Ltd., Tokyo, Japan

[21] Appl. No.: 561,603

[22] Filed: Dec. 14, 1983

[30] Foreign Application Priority Data

Dec. 30, 1982 [JP] Japan ..... 57-227944

[51] Int. Cl.[3] ..... B32B 3/00

[52] U.S. Cl. ..... 428/57; 428/61; 428/102; 428/246; 428/251; 428/253; 428/266; 428/920; 428/913

[58] Field of Search ..... 156/93; 428/102, 103, 428/104, 246, 251, 253, 256, 266, 57, 61, 920, 913

[56] References Cited

U.S. PATENT DOCUMENTS

| | | | |
|---|---|---|---|
| 2,372,632 | 3/1945 | Webb | 428/61 |
| 2,406,830 | 9/1946 | Herman et al. | 428/104 |
| 2,465,374 | 3/1949 | Haman et al. | 428/104 |
| 2,624,886 | 1/1953 | Herman | 428/104 |
| 3,246,621 | 4/1966 | Copeland | 156/93 |
| 4,192,116 | 3/1980 | Kelly | 52/469 |
| 4,303,712 | 12/1981 | Woodroof | 428/102 |
| 4,416,027 | 11/1983 | Perla | 156/93 |

*Primary Examiner*—James J. Bell

*Attorney, Agent, or Firm*—Edward C. Elliott

[57] ABSTRACT

This invention describes a water-impermeable elastomer-coated cloth composite in which the end sections of mutually adjacent elastomer-coated cloths are overlapped and sewn together in such a way that the thread passes up and down through this overlapped section. After a seam is sewn together, it is covered by an adhesive tape applied so that it extends over the sewn section of the seam and onto the portion of each section of the cloth beyond the sewn section to form a strong, watertight, airtight composite.

7 Claims, 5 Drawing Figures

ELASTOMER-COATED CLOTH COMPOSITE

BACKGROUND OF THE INVENTION

Field of the Invention

The present invention relates to an elastomer-coated cloth composite.

Information Pertaining to Invention

Elastomer-coated cloths have been used for some time as waterproof cloths, diving suits, belts, and flameproof cartons. Recently, however, proposals have been made to use elastomer-coated cloths as roofing materials for sports parks, gyms, outdoor restaurants, etc.

In U.S. Pat. No. 4,192,116, issued Mar. 11, 1980, to Kelly, a method of joining adjacent cured rubber membranes for use in a roof construction is taught. The lapping ends of the cured rubber membranes are sealed together with cement or the like, then an additional sealing means is provided. A composite structure comprising a lower uncured gum rubber strip and a cured reinforced rubber is applied over the seam and caused to be adhered to both portions of both of the overlapping membranes.

In U.S. Pat. No. 4,303,712, issued Dec. 1, 1981, to Woodruff, a fabric elastomer composite useful for various garments is described. The composite is a relatively thin elastomer membrane having a stretchable fabric joined thereto. He illustrates various methods of forming water tight joints in which adjacent pieces are sewn together. The sewn joint is then covered with a fabric elastomer strip which is bonded to the pieces of composite on each side of the sewn joint by means of a bead of room temperature vulcanizing silicone rubber applied between the composite and the fabric elastomer strip.

It is difficult to manufacture elastomer-coated cloth with a large surface area. However, because large surface areas are required when elastomer-coated cloths are to be used for building roofing materials and for large-scale tent materials, numerous pieces with a comparatively small surface area as manufactured in the factory must be joined.

Cloth-to-cloth joining is generally accomplished by overlapping the ends of the cloths and sewing or by fastening the ends of the cloths with adhesive. Such joining methods are satisfactory when the aim is a cloth composite with a small surface area. However, the strength and watertightness obtained when the ends of the cloths are merely overlapped and sewn together cause problems when the objective is a large surface area cloth composite for building roofing or for large-scale tent materials.

The drag of gravity and wind pressure causes stress which centers around the thread areas in a sewn construction. The area surrounding the thread can readily collapse and allow rain and wind-borne dust to enter by passing through the gaps around the threads in the overlapped section. Strength of the seam is the problem when the ends of cloths are attached only by adhesives.

The intent of the present invention is to propose a strong, watertight, airtight, well-joined, elastomer-coated cloth composite.

SUMMARY OF THE INVENTION

The water-impermeable elastomer-coated cloth composite of this invention is accomplished by overlapping the ends of the mutually adjacent water-impermeable elastomer-coated cloths and, in addition to sewing them together in such a way that the thread passes up and down through this overlapped portion, affixing them with adhesive tape placed so that it extends on both sides over the area of the cloth sewn as above and extending over the unsewn area of each elastomer-coated cloth to form an elastomer-coated cloth composite.

It is an object of this invention to disclose an elastomer-coated cloth composite having a strong, watertight, airtight seam that is simple to produce and gives a long useful life.

DESCRIPTION OF THE INVENTION

This invention relates to a water-impermeable elastomer-coated cloth composite consisting essentially of a first water-impermeable elastomer-coated cloth and a second water-impermeable elastomer-coated cloth, ends of the mutually adjacent first and second cloth being in overlapped contact, the overlapped ends being stitched together in such a way that a sewn portion is made by thread passing up and down through the overlapped ends, and in addition, adhesive tape of such a width that it is adhered over the sewn portion and is adhered to both the first water-impermeable elastomer-coated cloth and the second water-impermeable elastomer-coated cloth beyond the sewn portion.

The elastomer-coated cloth composite of the present invention is explained below based on the figures.

Figure 1:
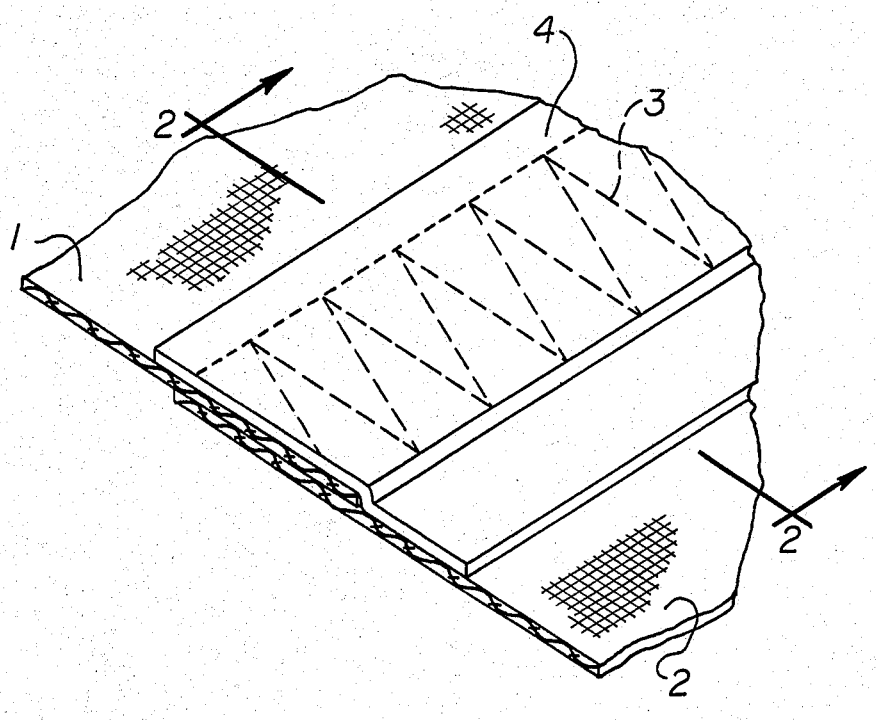
FIG. 1 shows an elastomer-coated cloth composite produced in accordance with this invention.
Figure 2:
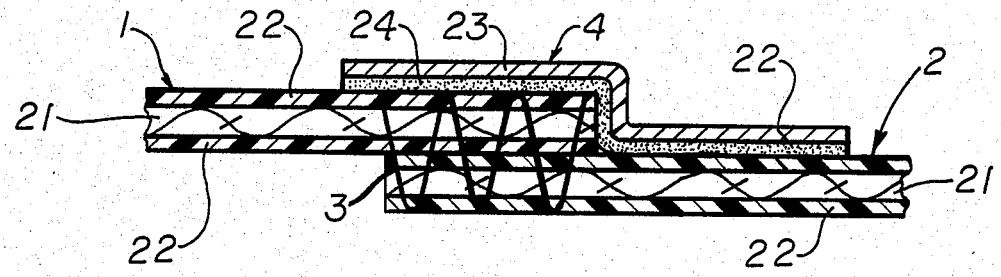
FIG. 2 is a cross section of the composite of FIG. 1.

FIGS. 1 and 2 show the elastomer-coated cloth composite are practical illustrations of the present invention.

In the figures, 1 is a first piece of elastomer-coated cloth and 2 is a second piece of elastomer-coated cloth. Both elastomer-coated cloths 1 and 2 have cloth 21 made of the fabrics, discussed below, on the inside. Their outer sides are coated with elastomer 22 and form a water-impermeable sheet. The respective end sections of these elastomer-coated cloths 1 and 2 are overlapped. They are sewn together by passing thread 3 in a zigzag pattern as seen in the plane view, FIG. 1, and by passing it from top to bottom as seen in the cross-section, FIG. 2, through the overlapping region. Adhesive tape 4 is affixed to this part where the ends overlap and are sewn together so that it extends over the surface of the sewn part of the first piece of elastomer-coated cloth 1 and over the surface of the second piece of the elastomer-coated cloth 2 to cover both the sewn portion and an adjacent portion beyond the sewn portion. This adhesive tape 4 is prepared by spreading adhesive 24 on one side of tape material 23. This adhesive 24 side is made to adhere to the surface of the above elastomer-coated cloths 1 and 2.

Because the composite construction discussed above is constructed by joining the ends of adjacent elastomer-coated cloths, the ends of multiple elastomer-coated cloths can be joined one to the other by repeating the above construction in order to produce building roofs and large-scale tent material.

Figure 3:
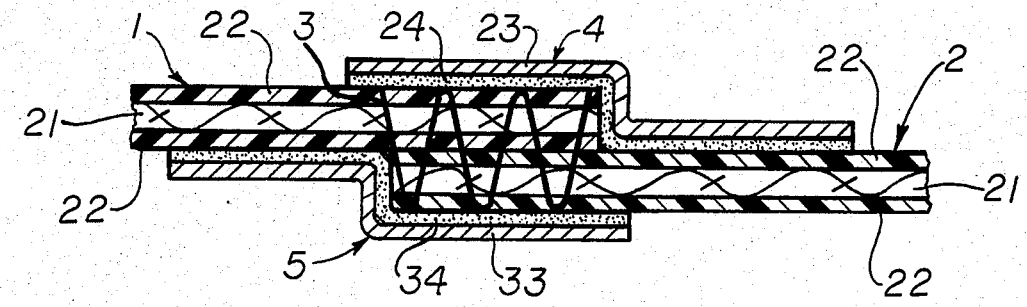
FIGS. 3, 4 and 5 are cross sections of other means of making a sewn seam and covering it with adhesive tape.

The adhesive tape discussed below can be applied not only to one side of the overlapped, sewn region of both elastomer-coated cloths 1 and 2, but as shown in FIG. 3, an adhesive tape 5 composed of substrate 33 and adhesive 34 can also be affixed to the reverse side so that it extends past the surface of the sewn area on the side of elastomer-coated cloth 2 and over the unsewn area on the side of elastomer-coated cloth 1. The joined part can be made even stronger and more watertight and airtight by affixing adhesive tapes 4 and 5 from both sides in this way.

Figure 4:
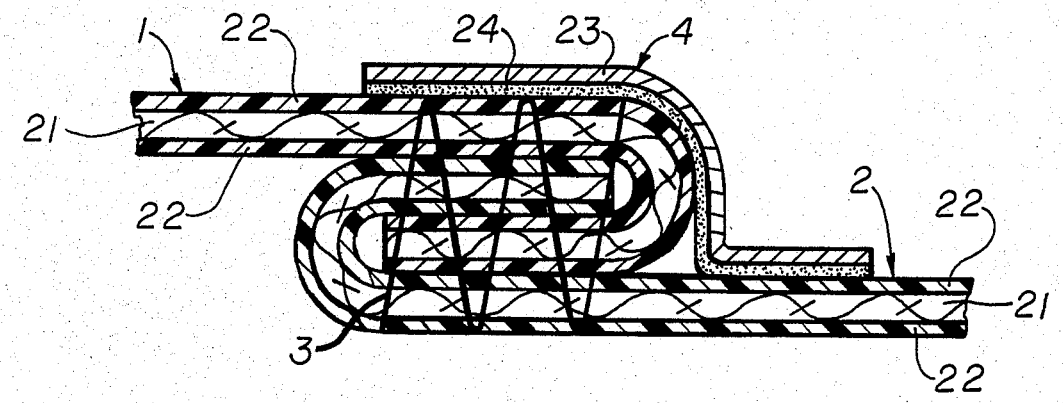

FIG. 4 shows another example of the present invention. Elastomer-coated cloths 1 and 2 are each folded over and the ends of the elastomer-coated cloths are mutually inserted into the folded-over area of the other to form an over-lapped region of a total of 4 layers. This overlapped region is sewn by thread 3. Then, adhesive tape 4 is affixed so that it extends past the sewn area of elastomer-coated cloth 1 and over the unsewn area of elastomer-coated cloth 2 in the same way.

Figure 5:
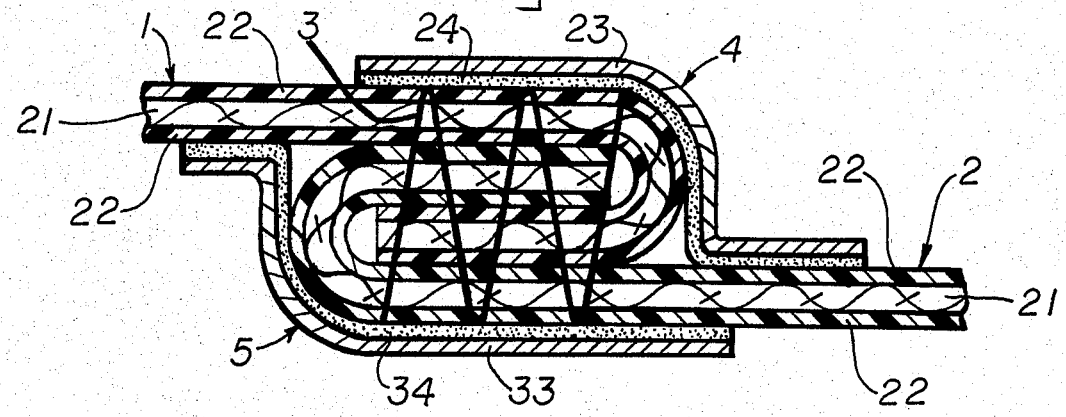

FIG. 5 shows another example in which adhesive tape 5 is affixed as above to the reverse side of the construction in FIG. 4, giving an adhesive tape on both sides.

The elastomer-coated cloth composites discussed above are joined solidly by overlapping the ends of the mutually adjacent elastomer-coated cloths and sewing this overlapping area with thread, but such sewn seams are not satisfactory for use as roofing materials and tent materials with a large surface area where they are submitted to large stress due to drag of gravity and wind pressure and, moreover, cannot prevent entry of rain and wind-borne dust from the gaps between the overlapped surfaces and the thread puncture holes. However, the elastomer-coated cloth composite of the present invention discussed above has this sewn region sealed by adhesive tape. Moreover, because it is constructed by affixing the adhesive tape so that it extends past the sewn area which fastens both elastomer-coated cloths and which extends onto the unsewn area of both elastomer-coated cloths, the joining strength between the two elastomer-coated cloths can be made extremely solid.

An elastomer-coated cloth as used in this invention is a cloth covered with elastomer. It is not especially limited so long as the elastomer and the cloth are bonded together, to form a water-impermeable cloth. Natural rubber, synthetic rubber, and thermoplastic elastomers can all be used as the elastomer which composes the elastomer-coated cloth. SBR, NBR, EPR, EPDM, chloroprene rubber, acrylic rubber, and silicone rubber can be used as the synthetic rubbers. Synthetic rubbers, especially silicone rubber, are preferable when the intent is a composite with a large surface area to be used outdoors. An organic peroxide vulcanized form, addition reaction cured form, or room temperature cured form can be used as this silicone rubber. This silicone rubber can also have a thin layer of silicone resin laminated and integrated on its surface.

The cloth which composes the elastomer-coated cloth can be a textile, a knit, a nonwoven cloth, a mesh, or laminated products of the above. Natural fibers, semisynthetic fibers, synthetic fibers, and inorganic fibers can be used as the fibers which compose these cloths. Synthetic fiber cloths, such as polyester fiber textiles, or inorganic fiber cloths, such as glass fiber cloths or metal fiber cloths, are preferable when the intent is a composite with a large surface area to be used outdoors because of their excellent weatherproof properties. When the intent is an outer material for gyms, sport parks, tennis courts, or outdoor restaurants which utilize natural lighting, i.e. when the intent is a film used for air film constructions, cloths which use fibers with large light permeability or cloths made of fibers which have voids between fibers with small basis weight or braided fibers are preferable.

The shape, thickness, and surface area of the elastomer-coated cloth are not particularly limited. Square, rectangular, triangular, and trapezoidal shapes can be used. The thickness can be 0.1 mm to 5 mm. It is preferable to use sizes of 100 $cm^2$ to 50 $m^2$.

The thread used to sew together the overlapped section of the elastomer-coated cloths should have the same or greater strength than the fibers or thread used in the elastomer-coated cloths. It should also be pliable. Glass fiber cords, carbon fiber yarns, synthetic fiber yarns, and metal cords made by entwining numerous fine wires are suitable as such thread. Inorganic fiber yarns such as glass fiber threads, carbon fiber yarns, and metal fiber threads, made by entwining numerous fine wires, are preferable from the standpoint of strength and durability.

The adhesive tape is one with adhesive laminated on one side of the tape. Plastic film tapes such as, e.g. polytetrafluoroethylene film tapes, polyester film tapes, polypropylene film tapes, varnish-impregnated cloth tapes such as, e.g. silicone varnish-impregnated glass cloth tapes, and elastomer-coated glass cloth tapes, are suitable as the tape.

When the intent is a composite with a large surface area to be used outdoors, a polytetrafluoroethylene film tape with silicone adhesive or a cured silicone-coated inorganic fiber cloth tape with silicone adhesive is preferable.

The adhesive which composes the adhesive tape should have strong adhesive power. Rubber adhesives, vinyl adhesives, acryl adhesives, and silicone adhesives are preferable. In particular, when the intent is a composite with a large surface area to be used outdoors, silicone adhesive is preferable. The adhesive must adhere to the elastomer-coated cloth composite used when the adhesive on the adhesive tape is pressed against the cloth composite.

This invention is explained below through the following examples which are included for illustrative purposes only and which should not be construed as limiting the invention which is properly set forth in the appended claims.

EXAMPLE 1

Two sheets of silicone rubber-coated glass cloth total thickness 0.75 mm, obtained by impregnating and coating both sides of plain fabric glass fibers (width 1.0 m, length 5.0 m, thickness 0.35 mm, glass cord width 1.0 mm/cord, glass cord number 5.5 cords/cm—Glasslon Cross MG 3000-INH-30 made by Asahi Glass Fiber Co., Ltd.) with transparent addition reaction cured liquid silicone rubber Toray Silicone Co., Ltd., SE 6705, were overlapped for a distance of 2 cm from the edge of the 5 m length of each sheet. This overlapped part was sewn in a zigzag with glass fiber thread 1.0 mm in diameter. Next, adhesive tape (polytetrafluoroethylene film tape with a thickness of 50 micrometers and a width of 6.0 cm coated with SH 4280 adhesive to a thickness of 20 micrometers), made by laminating silicone pressure-sensitive adhesive (Toray Silicone Co., Ltd., SH 4280) onto one side of a polytetrafluoroethylene film tape, was affixed in such a way that the pressure-sensitive adhesive contacted the silicone rubber-coated glass fiber cloths and so that the tape extended over the sewn part on one side of the cloth and for 3 cm over the surface of the unsewn part of the cloth adjacent to this sewn part as well as for 1 cm adjacent to the opposite side of the above sewn part. The silicone rubber-coated glass fiber cloth composite obtained in this way was translucent. The silicone-coated glass cloths were solidly joined. Even when water was sprayed over the joined part, it did not pass through to the inside, and no changes occurred when the composite was exposed outdoors. Samples joined only by sewing and joined only by adhesive tape were produced as comparative examples. When the joined part of the sewn sample sagged, water passed through to the inside when water was sprayed on top of it.

The sample joined by adhesive tape peeled away when the respective glass fiber cloths were pulled strongly in opposite directions.

EXAMPLE 2

Adhesive tape was affixed to the reverse side of the silicone rubber-coated glass fiber cloth of Example 1 in the same way as to the right side. The respective silicone rubber-coated glass fiber cloths of the silicone rubber-coated glass fiber cloth composite obtained in this way were solidly joined. Water did not pass through to the inside even when it was sprayed on top while the joined part was sagging and no changes occurred when the composite was exposed outdoors.

EXAMPLE 3

Two sheets of silicone rubber-coated metal fiber cloth (total thickness of 0.6 mm), obtained by impregnating and coating both sides of a plain fabric cloth made of stainless steel wires with a diameter of 0.1 mm (number of wires 17 wires/cm, width 1.0 m, length 2.5 m) with transparent addition reaction cured liquid silicone rubber (Toray Silicone Co., Ltd., DY 38-047), were used. These cloths were then overlapped for a distance of 3.0 cm along the 1.0 m long edge of each one. This overlapped area was sewn in a spiral with metal fiber thread made by entwining 6 stainless steel wires with diameters of 0.1 mm. Next, adhesive tape (made by laminating silicone pressure sensitive adhesive, Toray Silicone Co., Ltd., SH 4280, in a thickness of 40 micrometers onto one side of a silicone varnish-coated glass cloth tape having a thickness of 200 micrometers and a width of 9.0 cm), was affixed so that the pressure sensitive adhesive came into contact with the silicone rubber-coated metal fiber cloths and extended over the sewn part on one side of the cloth as well as for 4 cm over the surface of the unsewn part adjacent to the sewn part and for 2 cm adjacent to the other side of the sewn part on the same side of the cloth. The silicone rubber-coated metal fiber cloth composite obtained in this way was translucent. The respective silicone rubber-coated metal fiber cloths were solidly joined. Water did not pass through to the inside when it was sprayed on top even when the joined part was sagging. No changes occurred when it was exposed outdoors either. Water did pass through to the inside when it was sprayed on top of the joined parts of samples made by only sewing which were used as comparative examples. Samples which were joined by only adhesive tape peeled away when the respective cloths were strongly pulled in opposite directions.

EXAMPLE 4

Adhesive tape was affixed to the reverse side of the silicone rubber-coated metal fiber cloth composite of Example 3 in the same way as to the right side. The respective silicone rubber-coated metal fiber cloths of the silicone rubber-coated metal fiber cloth composite obtained in this way were solidly joined. Water did not penetrate to the opposite side even when it was sprayed on top while the joined part was sagging and no changes occurred when the composite was exposed outdoors.

That which is claimed is:

1. A water-impermeable elastomer-coated cloth composite consisting essentially of a first water-impermeable elastomer-coated cloth and a second water-impermeable elastomer-coated cloth, ends of the mutually adjacent first and second cloth being in overlapped contact, the overlapped ends being stitched together in such a way that a sewn portion is made by thread passing up and down through the overlapped ends, and in addition, adhesive tape, of the type which bonds upon contact to a surface without requiring a cure time, of such a width that it is adhered over the sewn portion and is adhered to both the first water-impermeable elastomer-coated cloth and the second water-impermeable elastomer-coated cloth beyond the sewn portion, the composite being of sufficient size to produce building roofs and large-scale tent material.

2. The water-impermeable elastomer-coated cloth composite according to claim 1 in which the thread is an inorganic fiber thread.

3. The water-impermeable elastomer-coated cloth composite according to claim 2 in which the first and second water-impermeable elastomer-coated cloths are a glass fiber cloth coated with silicone rubber.

4. The water-impermeable elastomer-coated cloth composite according to claim 2 in which the first and second water-impermeable elastomer-coated cloths are a metal fiber cloth coated with silicone rubber.

5. The water-impermeable elastomer-coated cloth composite according to claim 1 in which the adhesive tape is a polytetrafluoroethylene film tape covered with silicone adhesive.

6. The water-impermeable elastomer-coated cloth composite according to claim 1 in which the adhesive tape is a cured silicone-coated inorganic fiber cloth tape covered with silicone adhesive.

7. A process for producing a water-impermeable, elastomer-coated cloth composite, being of sufficient size to produce building roofs and large-scale tent material, consisting essentially of placing an end of a first water-impermeable elastomer-coated cloth and an end of a second water-impermeable elastomer-coated cloth in mutually adjacent overlapping contact, stitching the overlapped ends together in such a way that thread passes up and down through this overlapped portion to give a sewn portion, and, in addition, adhering adhesive tape, of the type which bonds upon contact to a surface without requiring a cure time, over the sewn portion, the adhesive tape being of such a width that it is adhered over the sewn portion and adhered to both the first water-impermeable elastomer-coated cloth and the second water-impermeable elastomer-coated cloth beyond the overlapped portion.

* * * * *